US011407567B2

(12) United States Patent
Tidwell et al.

(10) Patent No.: US 11,407,567 B2
(45) Date of Patent: Aug. 9, 2022

(54) CHILD-RESISTANT LID AND RELATED METHODS

(71) Applicant: PWS Packaging Services, Inc., La Jolla, CA (US)

(72) Inventors: Justin Tidwell, Brea, CA (US); William Tidwell, Brea, CA (US)

( * ) Notice: Subject to any disclaimer, the term of this patent is extended or adjusted under 35 U.S.C. 154(b) by 2 days.

(21) Appl. No.: 17/064,554

(22) Filed: Oct. 6, 2020

(65) Prior Publication Data

US 2022/0106090 A1 Apr. 7, 2022

Related U.S. Application Data

(63) Continuation-in-part of application No. 17/064,008, filed on Oct. 6, 2020.

(51) Int. Cl.
*B65D 50/06* (2006.01)

(52) U.S. Cl.
CPC ..... *B65D 50/06* (2013.01)

(58) Field of Classification Search
CPC .... B65D 2251/1058; B65D 2251/1033; B65D 2251/1075; B65D 2251/1016; B65D 43/161; B65D 51/007; B65D 41/46; B65D 41/48; B65D 50/06
See application file for complete search history.

(56) References Cited

U.S. PATENT DOCUMENTS

| | | | | |
|---|---|---|---|---|
| 2008/0083754 | A1* | 4/2008 | Robinson | B65D 17/4012 220/269 |
| 2019/0177052 | A1* | 6/2019 | Battaglia | B65D 43/18 |
| 2020/0130902 | A1* | 4/2020 | Sanguinet | B65D 50/06 |
| 2020/0130903 | A1* | 4/2020 | Ornduff | B65D 47/0838 |
| 2020/0270033 | A1* | 8/2020 | Sanguinet | B65D 55/16 |

* cited by examiner

*Primary Examiner* — Allan D Stevens
(74) *Attorney, Agent, or Firm* — Buche & Associates, P.C.; John K. Buche; Bryce A. Johnson

(57) ABSTRACT

Disclosed is a child-resistant beverage lid with a tabbed cover that is attached to the base of the lid via a hinge. The lid may be removed by pulling up on the tab with sufficient force that it lifts the cover up and the lid up and off of a can.

3 Claims, 22 Drawing Sheets

CHILD-RESISTANT LID AND RELATED METHODS

CROSS-REFERENCE TO RELATED APPLICATIONS

This application is a continuation-in-part of U.S. application Ser. No. 17/064,008, entitled Child-Resistant Lid and Related Methods (filed Oct. 6, 2020), which is incorporated herein by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of child-resistant lids for canned beverages and storage units.

Background of the Invention

With the increased sale and use of *cannabis* related products, there is an increased need for child-resistant packaging, lids, containers, and storage units for such products. As medicinal and recreational use of *cannabis* and *cannabis* related products increases, there are more requirements that these *cannabis* products be stored in child-resistant containers and packaging. For example, the state of California requires that all *cannabis* flower, pre-rolls, and *cannabis* products sold within California be in child-resistant packaging. One type of product that is becoming increasingly popular are *cannabis* infused beverages. Accordingly, the cans for beverages containing *cannabis* substances should be sealed with a child-resistant lid. One efficient method of providing child-resistant cans is to secure a child-resistant lid onto a common beverage can.

Child resistant lids are also desirable for other types of beverages that may be toxic or harmful if consumed by a child. Accordingly, a need exits for a child-resistant lid that can be secured to the existing beverage can design, so that *cannabis* related beverages may be child-resistant when stored.

SUMMARY OF THE INVENTION

In view of the foregoing, an object of this specification is to disclose a lid that is child-resistant.

It is a further object of this disclosure to specify a lid that is tamper evident.

Other objectives of the disclosure will become apparent to those skilled in the art once the invention has been shown and described.

BRIEF DESCRIPTION OF THE SEVERAL VIEWS OF THE DRAWINGS

The manner in which these objectives and other desirable characteristics can be obtained is explained in the following description and attached figures in which.

Figure 1:
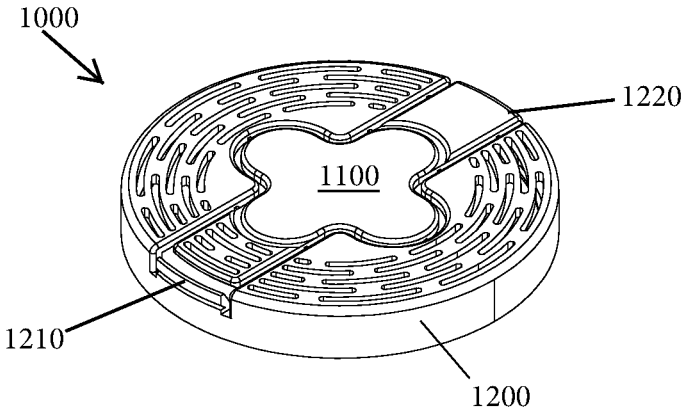
FIG. 1 is a front, top perspective view of an embodiment of a child-resistant lid.

In the drawings, the following reference numerals correspond with the associated components of the lid:

1000—lid
1100—cover
1110—tab
1200—base
1210—lock
1220—hinge
1230—protruding ledge/can-attachment snap.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed are several embodiments of a child-resistant lid. A first embodiment of a child-resistant lid is shown in FIGS. 1 through 9. A second embodiment of a child-resistant lid is shown in FIGS. 10 through 20. The second embodiment is also tamper evident. Suitably, either embodiment of the lid may be snap-fit onto the rim of a typical pop-top aluminum can that is known to hold beverages like beer or soda. In either lid, a release mechanism may be triggered so that the lid may be opened to expose the pull-tab of the aluminum can whereby a user may open the can to consume any contained beverage. In the second embodiment, a tamper evident strip is disposed over the pull tab so that said strip breaks when anyone tries to access the pull tab of the aluminum can. A more detailed description of the preferred embodiments are provided below with reference to the figures.

Figure 2:
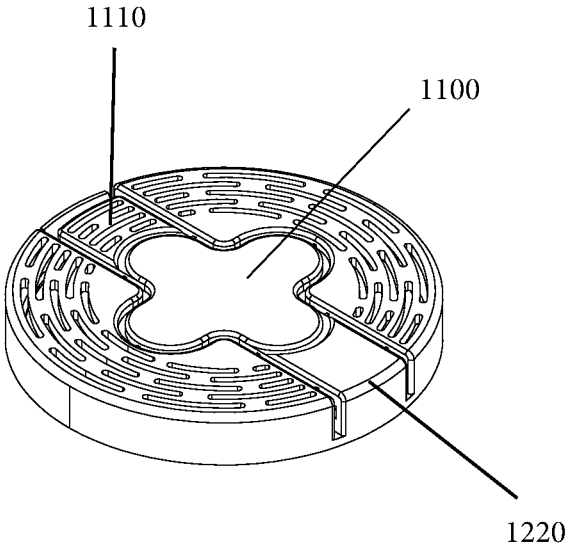
FIG. 2 is a rear, top perspective view of the lid of FIG. 1.
Figure 3:
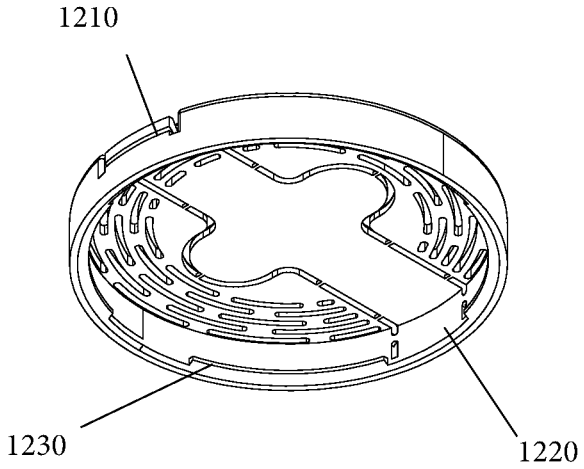
FIG. 3 is a front, bottom perspective view of the lid of FIG. 1.
Figure 4:
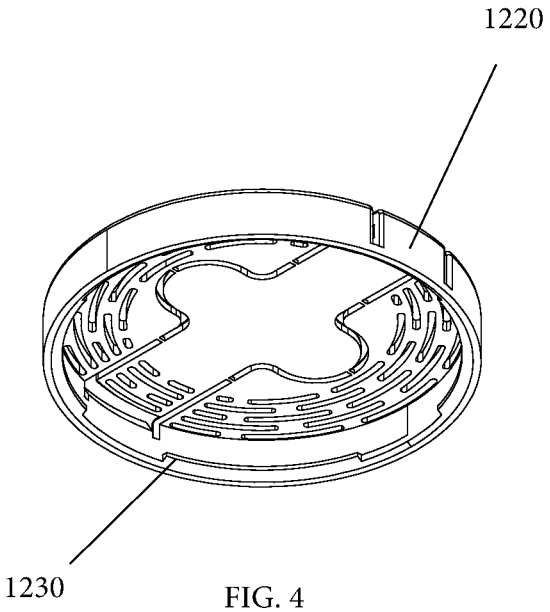
FIG. 4 is a rear, bottom perspective view of the lid of FIG. 1.
Figure 5:
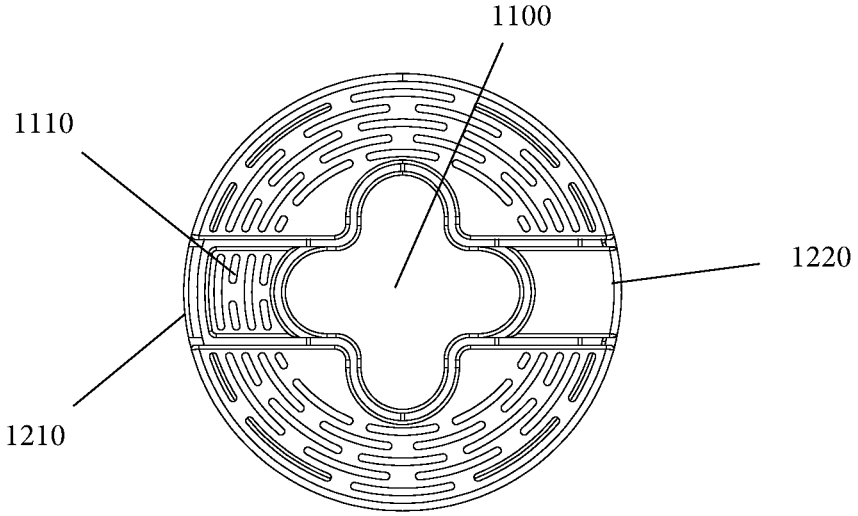
FIG. 5 is a top view of the lid of FIG. 1.
Figure 6:
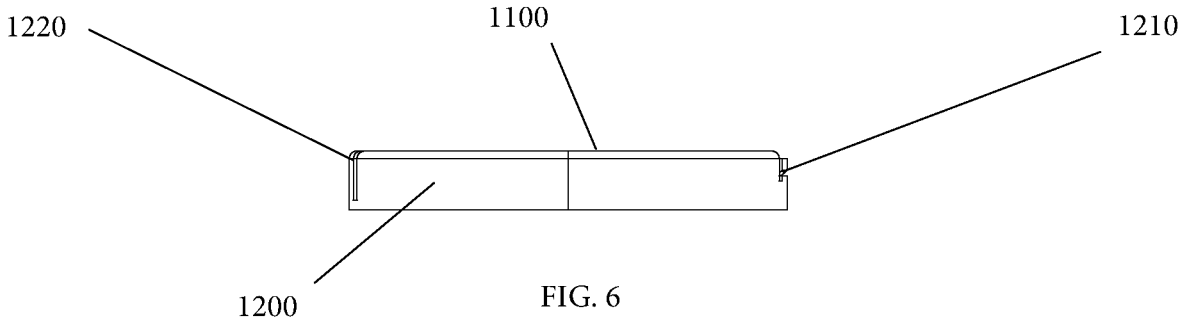
FIG. 6 is a right-side view of the lid of FIG. 1.
Figure 7:
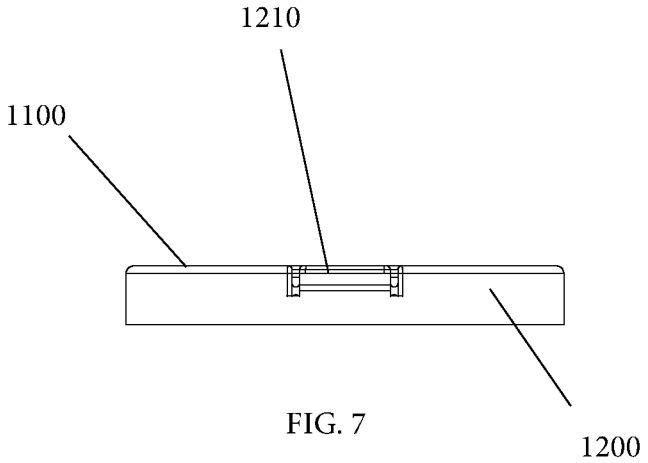
FIG. 7 is a front view of the lid of FIG. 1.
Figure 8:
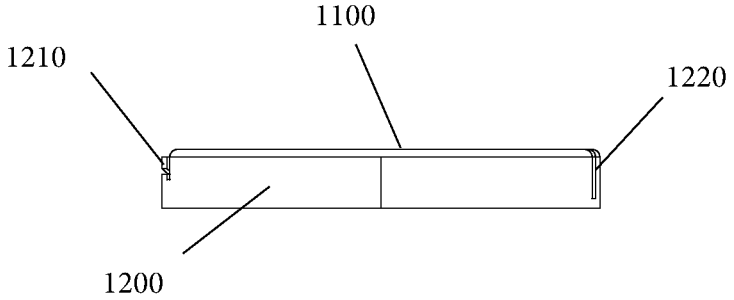
FIG. 8 is a left side view of the lid of FIG. 1.
Figure 9:
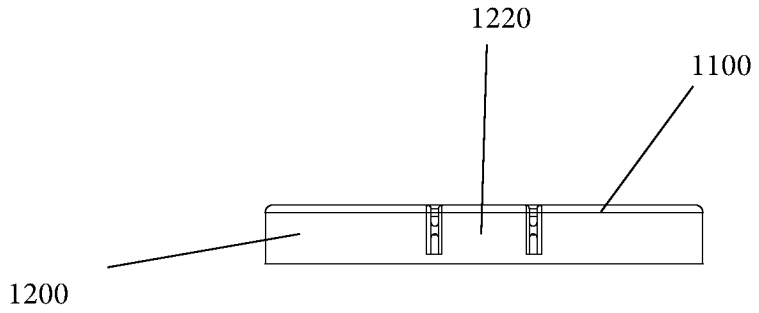
FIG. 9 is a rear view of the lid of FIG. 1.

FIG. 1 is a front, top perspective view of an embodiment of a child-resistant lid 1000. FIG. 2 is a rear, top perspective view of the lid 1000. FIG. 3 is a front, bottom perspective view of the lid 1000. FIG. 4 is a rear, bottom perspective view of the lid 1000. FIG. 5 is a top view of the lid 1000. FIG. 6 is a right-side view of the lid of FIG. 1. FIG. 7 is a front view of the lid. FIG. 8 is a left side view of the lid 1000. FIG. 9 is a rear view of the lid of FIG. 1. As shown in these figures, the lid 1000 suitably comprises: a generally disk-shaped base 1200 with a lock 1210 on one side, a hinge on another side, and a protruding ledge/can-attachment snap 1230 on the underside; and, a cloverleaf-shaped cover 1100 with a tab.

Referring to FIGS. 1 and 2, the cover 1100 is disposed in the top of the base 1200 and connected thereto via the hinge 1220. Suitably, the cover 1100 is held to its position within the base via the lock 1210. As discussed later below, the cover may be hinged out of the base by releasing the lock and pulling the cover 1100 via the tab 1110 so that the cover 1100 pivots around the hinge to open the lid 1000.

Referring to FIGS. 3 and 4, the inside of the base 1200 may feature an annular crevice with a protruding ledge/can-attaching snap 1230, or protruding ledges/can-attaching snaps 1230, that form a snap-fit over the lip edge of the top of a can whenever the lip of the can is inserted into the annular crevice. This feature of the lid 1000 allows the lid 1000 to be snapped in place and secured over the top of a can to form a child-resistant seal.

FIG. 5 shows the cloverleaf shaped cover 1100. Suitably, the cover 1100 is cloverleafed so that, when open, a pull-tab of a soda or beer can may be accessed from any one of the four cloverleaves. In other words, the pull-tab of a soda or beer can may need to be aligned with one of the cloverleaves via rotation of the lid around the lip of the can in order for the pull-tab of the soda or bear can to be accessible.

Figure 10:
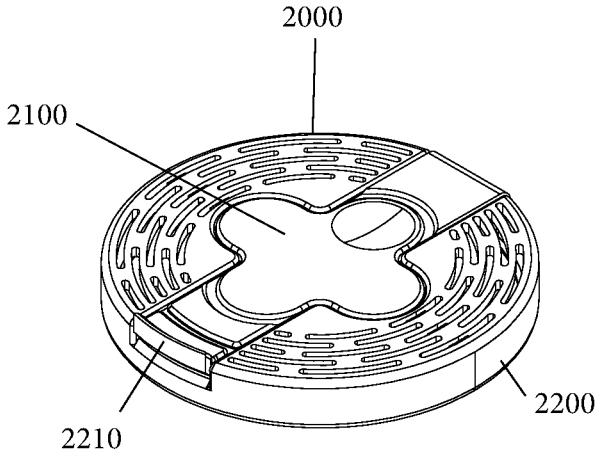
FIG. 10 is a front, top perspective view of an embodiment of a child-resistant and tamper evident lid.
Figure 11:
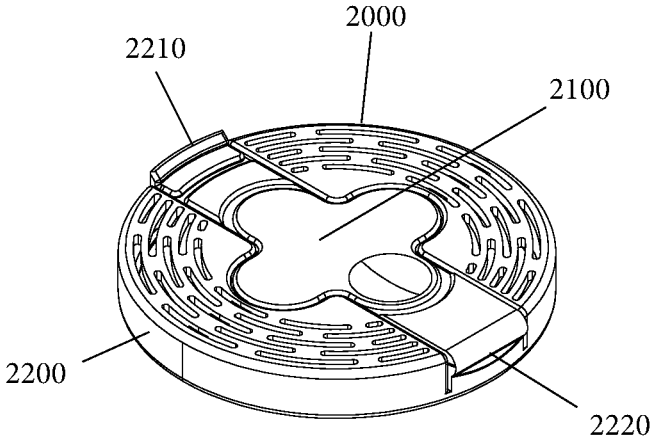
FIG. 11 is a rear, top perspective view of the lid of FIG. 10.
Figure 12:
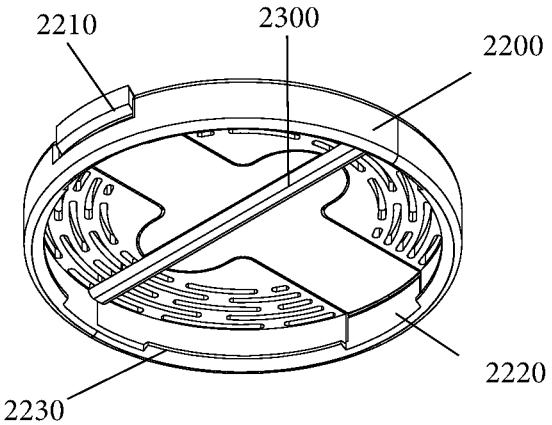
FIG. 12 is a front, bottom perspective view of the lid of FIG. 10.
Figure 13:
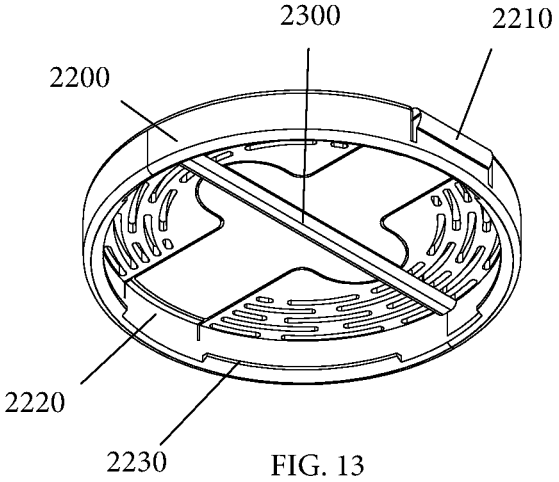
FIG. 13 is a rear, bottom perspective view of the lid of FIG. 10.
Figure 14:
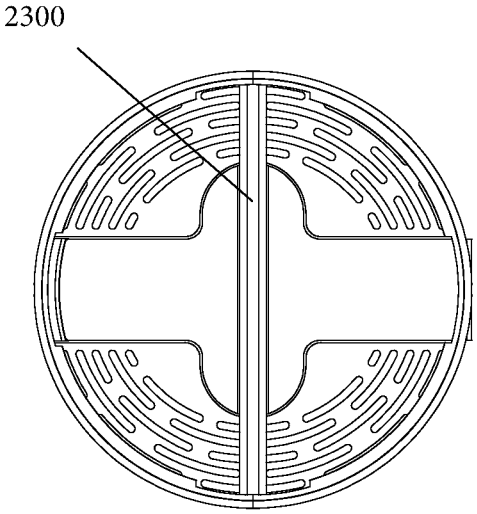
FIG. 14 is a bottom view of the lid of FIG. 10 with a tamper evident strip.
Figure 15:
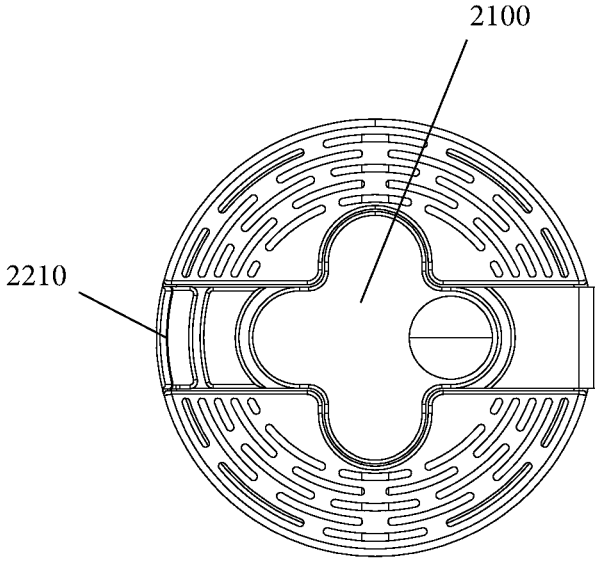
FIG. 15 is a top view of the lid of FIG. 10.
Figure 16:
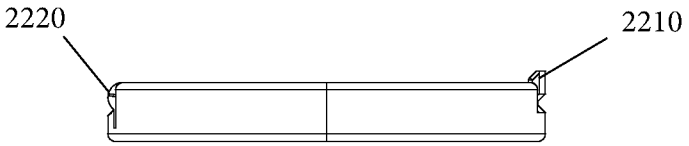
FIG. 16 is a right-side view of the lid of FIG. 10.
Figure 17:
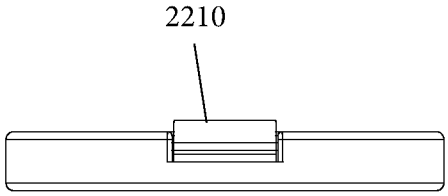
FIG. 17 is a front view of the lid of FIG. 10.
Figure 18:
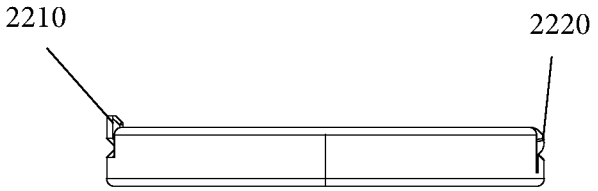
FIG. 18 is a left side view of the lid of FIG. 10.
Figure 19:
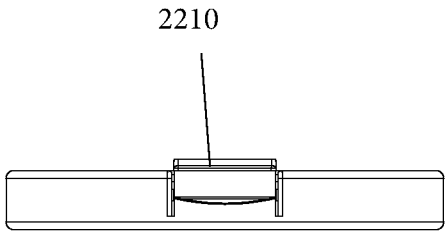
FIG. 19 is a rear view of the lid of FIG. 10.

FIG. 10 is a front, top perspective view of an embodiment of a child-resistant and tamper evident lid 2000. FIG. 11 is a rear, top perspective view of the lid 2000. FIG. 12 is a front, bottom perspective view of the lid 2000. FIG. 13 is a rear, bottom perspective view of the lid 2000. FIG. 14 is a bottom view of the lid 2000 with a tamper evident strip 2300. FIG. 15 is a top view of the lid 2000. FIG. 16 is a right-side view of the lid 2000. 10. FIG. 17 is a front view of the lid 2000. FIG. 18 is a left side view of the lid 2000. FIG. 19 is a rear view of the lid 2000. As shown in these figures, the lid 2000 suitably comprises: a generally disk-shaped base 2200 with a locking mechanism 2210 on one side, a hinge 2220 on another side, and a protruding ledge/can-attachment snap 2230 on the underside; a cloverleaf-shaped cover 2100 with a tab 2110; and, a tamper evident strip 2300 across the underside of the base 2200.

Referring to FIGS. 10 and 11, the cover 2100 is disposed in the top of the base 2200 and connected thereto via the hinge 2220. Suitably, the cover 2100 is held to its position within the base 2200 via the lock 2210. As discussed later below, the cover may be hinged out of the base 2200 by releasing the lock 2210 and pulling the cover 2100 via the tab 2110 so that the cover 2100 pivots around the hinge 2220 to open the lid 2000.

Referring to FIGS. 3 and 4, the inside of the base 2200 may feature an annular crevice with a protruding ledge/can-attaching snap 2230, or protruding ledges/can-attaching snap 2230, that form a snap-fit over the lip edge of the top of a can whenever the lip of the can is inserted into the annular crevice. This feature of the lid 2000 allows the lid 2000 to be snapped in place and secured over the top of a can to form a child-resistant seal.

FIG. 5 shows the cloverleaf shaped cover 2100. Suitably, the cover 2100 is cloverleafed so that, when open, a pull-tab of a soda or beer can may be accessed from any one of the four cloverleaves. In other words, the pull-tab of a soda or beer can may need to be aligned with one of the cloverleaves via rotation of the lid around the lip of the can in order for the pull-tab of the soda or bear can to be accessible.

Figure 20:
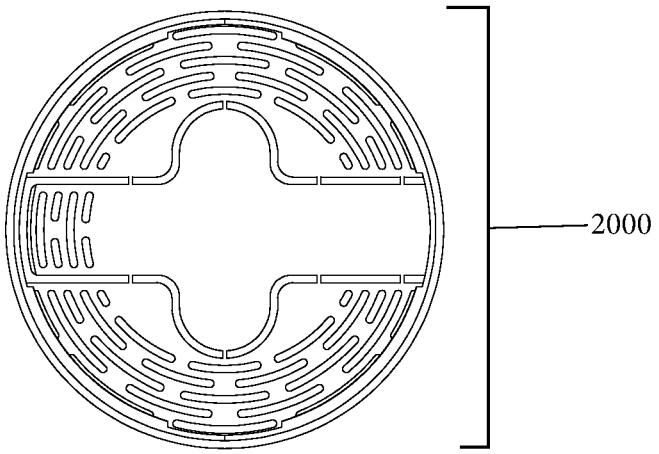
FIG. 20 is a bottom view of the lid of FIG. 10 without the tamper evident strip.

FIG. 20 is a bottom view of an alternate configuration of the lid 2000. When FIG. 20 is compared to FIG. 14, one can see that the FIG. 20 shows the lid 2000 without the tamper evident strip 2300. As discussed in greater detail below, once the lid is open, the tamper evident strip may be removed before the aluminum beverage can be opened via its pull-tab.

Figure 21A:
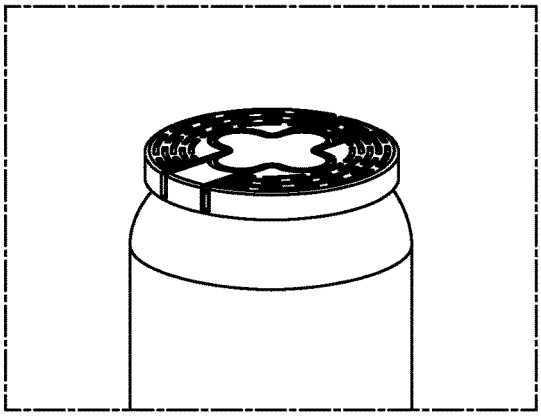
FIG. 21*a* is an environmental view of the lid on a can.
Figure 21B:
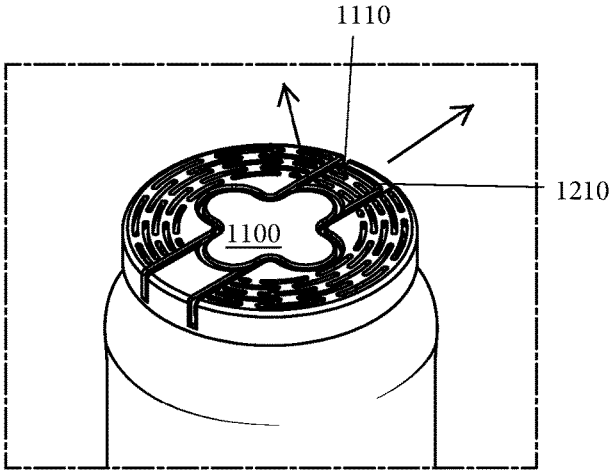
FIG. 21*b* is an exemplary step of one method of opening the tab to expose the top of the can and/or remove the lid.
Figure 21C:
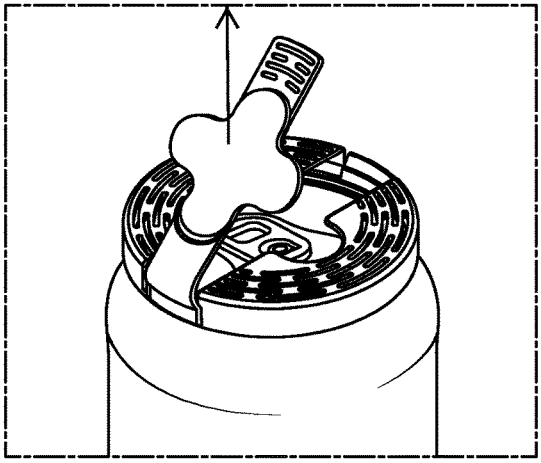
FIG. 21*c* is an exemplary step of one method of opening the tab to expose the top of the can and/or remove the lid.

FIG. 21*a* to FIG. 21*c* are environmental views of the lid on a can and exemplary steps of opening the tab to expose the top of the can and/or remove the lid. FIGS. 21*a* to 21*c* collectively represent a flow-diagram of removing one embodiment of the child-resistant lid. Referring to FIGS. 21*a*, 21*b*, and 21*c*, in use, a user may make a can child resistant by snapping the base of the lid over the edges of the top of a can. Once the lid is secured on top of the can, to expose the top of the can to be open to be consumed, a user may: (i) push the lock 1210 outward until the lock 1210 breaks apart or snaps out of the tab 1110; (ii) grip the tab 1110; (ii) pull the tab 1110 back, wherein the cloverleaf shaped cover 1100 is lifted up; and, (iii) pull the cloverleaf shaped cover 1100 up with sufficient force to pull the entire lid off of, and dislodge the lid from, the can.

Figure 22A:
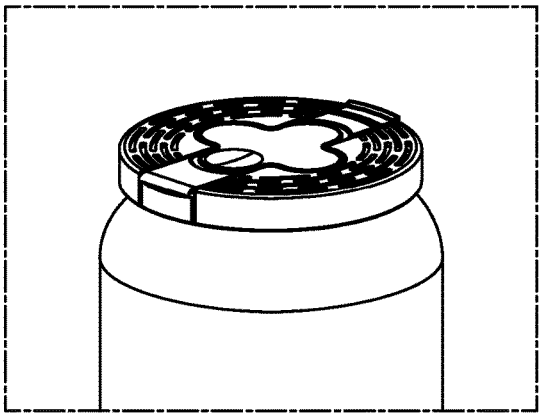
FIG. 22*a* is an environmental view of the lid on a can.
Figure 22B:
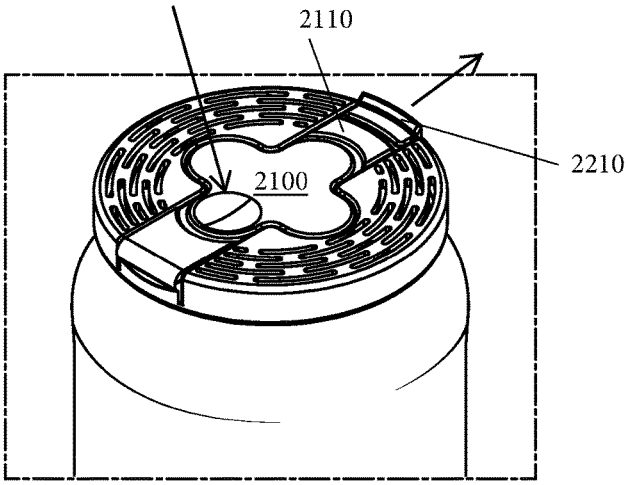
FIG. 22*b* is an exemplary step of one method of opening the tab to expose the top of the can and/or remove the lid.
Figure 22C:
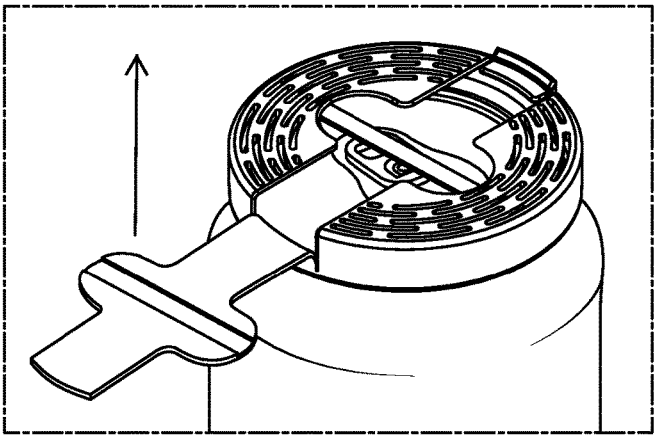
FIG. 22*c* is an exemplary step of one method of opening the tab to expose the top of the can and/or remove the lid.

FIGS. 22*a* to 22*c* are environmental views of the lid on a can and exemplary steps of opening the tab to expose the top of the can and/or remove the lid. FIGS. 22*a* to 22*c* collectively represent a flow diagram of removing an alternative embodiment of the child-resistant lid. Referring to FIGS. 22*a* to 22*c*, in a preferred embodiment, the cloverleaf shaped cover 2100 features a groove or notch on the end of the tab 2110 that communicates with a tongue or peg of the lock 2210. Once the lid is secured to the top of a can, a user may remove the lid pressing down on the cloverleaf shaped cover 2100 to release the a groove or notch from the tab 2110 the cover 2100 from the tongue or peg on the lock 2210 and then push the lock 2210 back and outward, thereby, allowing the user to lift the cover 2100 without interference from the lock. Once, the cover 2100 is lifted, a user may pull on the cover to release the lid from the can and remove the entire lid.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A method of making a beverage can with a pull-tab child-resistant comprising the steps of:

(a) obtaining a lid comprising a disk-shaped base with a top and a at least one protruding ledge around an inside of the base, wherein the top features a cloverleaf-shaped cover diametrically attached across the top of the base by (1) a hinge that is connected to a leaflet of the cloverleaf-shaped cover and by (2) a tab on an opposite leaflet of the cloverleaf-shaped cover that is configured to be held under a locking mechanism of the base;

(b) placing the lid over a lip of the beverage can so that the lip of the beverage can is adjacent the at least one protruding ledge of the base; and, (c) pushing down on the lid until the at least one protruding ledge forms a snap-fit over the lip of the beverage can to secure the lid over the beverage can with the cloverleaf-shaped cover over the pull tab of the beverage can.

2. The method of claim 1 wherein the lid further comprises a tamper evident strip that is diametrically positioned on the inside of the base and that is attached to the base and wherein the method of claim 1 further comprises the step of:

(d) locating the tamper evident strip over the pull tab of the beverage can.

3. The method of claim 2 wherein the cover further comprises a plurality of holes through a periphery of the top of the lid.

* * * * *